US008118190B2

(12) United States Patent
Coonce

(10) Patent No.: US 8,118,190 B2
(45) Date of Patent: Feb. 21, 2012

(54) SYSTEM OF RELEASABLY INTERLOCKING CONTAINER COVERS

(75) Inventor: Ryan J. Coonce, Palatine, IL (US)

(73) Assignee: The Glad Products Company, Oakland, CA (US)

( * ) Notice: Subject to any disclaimer, the term of this patent is extended or adjusted under 35 U.S.C. 154(b) by 620 days.

(21) Appl. No.: 12/160,299

(22) PCT Filed: Jan. 16, 2007

(86) PCT No.: PCT/US2007/060567

§ 371 (c)(1),
(2), (4) Date: Jul. 8, 2008

(87) PCT Pub. No.: WO2007/084889

PCT Pub. Date: Jul. 26, 2007

(65) Prior Publication Data

US 2009/0000977 A1 Jan. 1, 2009

(51) Int. Cl.
*B65D 21/036* (2006.01)
*B65D 43/03* (2006.01)
*B65D 43/08* (2006.01)

(52) U.S. Cl. ..... 220/781; 206/508; 206/509; 220/793; 220/380

(58) Field of Classification Search ..... 220/781, 220/793, 780, 380; 206/508, 509, 515
See application file for complete search history.

(56) References Cited

U.S. PATENT DOCUMENTS

| | | | | |
|---|---|---|---|---|
| 5,894,953 | A * | 4/1999 | Ramirez | 220/785 |
| 7,337,917 | B2 * | 3/2008 | Kortleven | 220/793 |
| 7,661,528 | B2 * | 2/2010 | Vovan et al. | 206/508 |
| 7,726,483 | B2 * | 6/2010 | Ramanujam et al. | 206/508 |
| 2003/0183641 | A1 * | 10/2003 | Asbury | 220/781 |
| 2005/0194390 | A1 | 9/2005 | Savicki, Jr. et al. | |
| 2005/0224498 | A1 | 10/2005 | Savicki | |
| 2009/0095754 | A1 * | 4/2009 | Liu | 220/380 |

* cited by examiner

*Primary Examiner* — Anthony Stashick
*Assistant Examiner* — Niki Eloshway
(74) *Attorney, Agent, or Firm* — David Peterson

(57) ABSTRACT

A container 100 includes a cover 102 and a base 104. The container cover 102 includes a first closure portion, an engagement portion 208, and an alignment portion. The base 104 includes a second closure portion. The first closure portion of the cover 104 is sealingly engageable with the second closure portion of the base 104 to define a sealed storage area. The covers 102 stack together in two different ways. First, the covers 102 can be stacked into an "aligned" stack. Second, the covers 102 can be stacked into a releasably locked stack. The alignment portion of the cover 102 is engageable with the alignment portion of a second cover 602 to form an aligned cover stack. The engagement portion 208 of the cover 102 includes one or more engagement lugs 424 that are engageable with corresponding engagement lugs 624 of the engagement portion 608 of a second cover 602 to form a releasably locked cover stack 750. The engagement portion 208 of the cover 102 further includes one or more drainage channels 444 that provide a passageway for liquid entrapped between locked covers to quickly drain or evaporate.

2 Claims, 11 Drawing Sheets

SYSTEM OF RELEASABLY INTERLOCKING CONTAINER COVERS

FIELD OF THE INVENTION

The present invention relates generally to containers, and, more particularly, to containers whose covers align together when stacked in a first position and which can be locked together in a second position. The present invention further provides drainage channels for entrapped liquid to drain from between interlocked covers.

BACKGROUND OF THE INVENTION

Rigid, thermoplastic food containers, made up of a base and a cover, are generally known. The prior art covers and bases are economically constructed from relatively thin-gauge plastic so that the user can either wash them after use or dispose of them with the view that their purchase price allows them to be used as a consumable good. The prior art container can be readily manufactured, for example, with conventional thermoforming equipment or thin-walled injection molding. The cover can be made from a semi-transparent material to ensure satisfactory visibility of the container's contents. The conventional containers are suitable for refrigerator, freezer, microwave, and machine dishwasher use.

Users often accumulate a large number of these containers in different sizes and shapes. When not in use, the containers are often stored haphazardly into drawers. In this case, the unused containers take up a great deal of room, and finding a matching base and cover in a disarranged drawer may be difficult. To avoid this, some users stack the containers in cabinets. While the bases of the containers usually nest and therefore take up less room than in a disorganized drawer, it may still be difficult to match a base with a cover. In addition, the covers may not stack and the covers may tend to topple down. When the containers are in use to store food, the containers are often stacked one on top of another in cabinets or in a refrigerator. These stacks may be precarious, and their fall may cause food to spill from the containers. Many users would find it desirable if the containers, whether empty or in use, could be stored in a more space efficient manner, less precariously, and more structurally rigid. Further, many users would also find it desirable if the containers when stored in a space efficient manner did not do so in a way that entrapped water or other liquids between the covers or containers. Design of prior art containers has not effectively integrated a component organizational tool. Further, improvements that enhance drying and aligning in current container products are needed

SUMMARY OF THE INVENTION

In view of the foregoing, the present invention provides containers whose covers can be stacked together in two different ways. First, the covers can be stacked and configured into an "aligned" stack. The aligned stack provides enough structural rigidity for bulk handling during manufacturing. Second, the covers can be stacked, interlocked through an engagement portion one to another, and configured into a "locked" stack. The locked stack provides even more structural rigidity than does the aligned stack and is useful when storing unused covers. Further, when stored in this locked, space-efficient manner, the covers provide one or more drainage channels that allow any liquid entrapped between the adjacent cover engagement portions that interlock the covers together. Finally, once the stack of covers is locked, the top cover of the stack can be easily released from the locked stack and removed. The present invention provides an effective organizational tool for containers.

In some embodiments, the cover includes a first closure portion, an engagement portion, and an alignment portion. The base includes a second closure portion. The first closure portion of the cover is sealingly engageable with the second closure portion of the base to define a substantially sealed, leak-proof, and re-sealable storage area for items such as food. The alignment portion of the cover is engageable with the alignment portion of a second cover to form an aligned cover stack. The engagement portion of the cover is engageable with the engagement portion of a second cover to form a system of covers in a locked cover stack. In one embodiment, once engaged to form a locked stack, the engagement portion of the top cover of the locked stack is disengageable from the engagement portion of the cover in the cover stack immediately below the top cover.

As noted above, it is well known to those of ordinary skill in the art, that the cover may be sealingly engaged with its base. Related U.S. Provisional Patent Application No. 60/655,830, filed Feb. 23, 2005, co-owned with the present invention and incorporated herein in its entirety by reference, describes closure portions used to engage the cover with the base of the container. As described, the first closure portion of the cover is sealingly engageable with the second closure portion of the base to define a substantially sealed, leak-proof, and re-sealable storage area for items such as food. The container uses a locking rim design that includes both inside and outside seals. Containers can be embodied with a variety of closure designs including outer closures and/or inner closures.

The first and second closure portions can be configured to be slightly different in size to form an interference fit therebetween. The interference between the closure portions can provide the sealing engagement between the closure portions. As a result, when the two pieces are engaged, a positive seal can be formed between sealing surfaces around the perimeters of the base and of the cover. The engagement of the first and second closure portions can be accompanied by an audible "snap" indicating that the container is securely closed. In general, the closure portions described in U.S. Provisional Patent Application No. 60/655,830 are examples only, and many other types of closure portions could be used with the present invention.

The present invention finds application in disposable plastic containers as well as in durable plastic containers. The alignment and drying benefit may be designed into any product that is locked, snapped, or frictionally engaged to other mating parts. For example, the present invention may be applied to engagement features of the plastic containers described in U.S. Provisional Patent Application No. 60/655,830. The present invention is especially effective when applied to products that undergo frequent hand or machine washing and subsequent storage.

BRIEF DESCRIPTION OF THE DRAWINGS

The features of the present invention will become apparent to one of ordinary skill in the art upon reading the detailed description, in conjunction with the accompanying drawings, wherein.

DETAILED DESCRIPTION OF THE INVENTION

Figure 1:
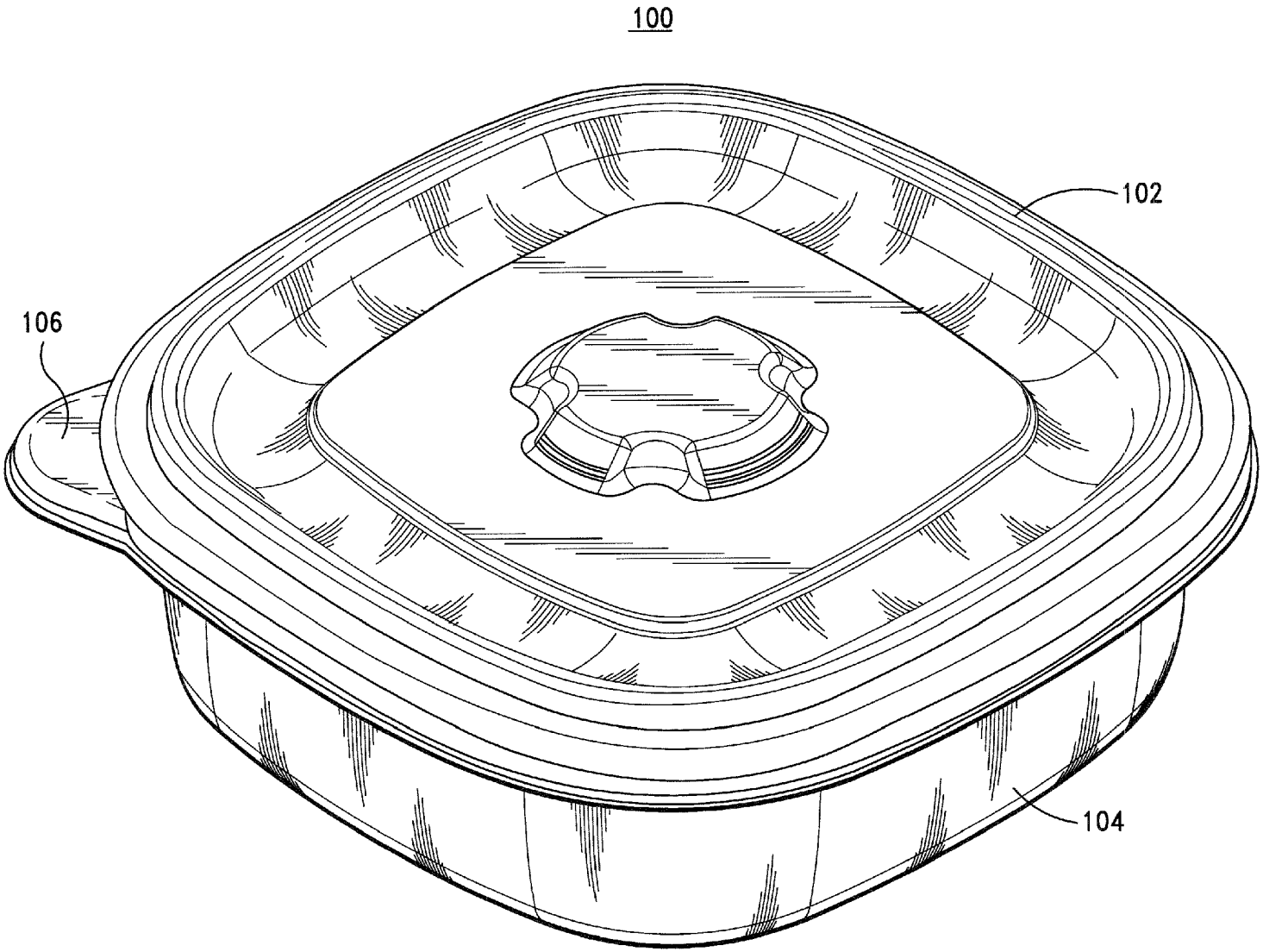
FIG. 1 is a top isometric view of a container with a cover and a base according to an embodiment of the present invention.

Turning to the drawings, wherein like reference numerals refer to like elements, an embodiment of the present invention is illustrated in FIGS. 1 through 7. Referring to FIG. 1, a container 100 includes a flexible cover 102 sealingly engaged to a base 104. In the example of FIGS. 1 through 7, the container 100 is depicted as substantially square with rounded corners. In other embodiments of the present invention, the container 100 has other shapes such as rectangular, circular, or elliptical. The cover 102 can include at least one gripping tab 106 to facilitate removal of the cover 102 from the base 104. In some embodiments, the gripping tab 106 includes one or more cross-ribs or a textured surface to improve a user's grip on the tab 106.

Figure 2A:
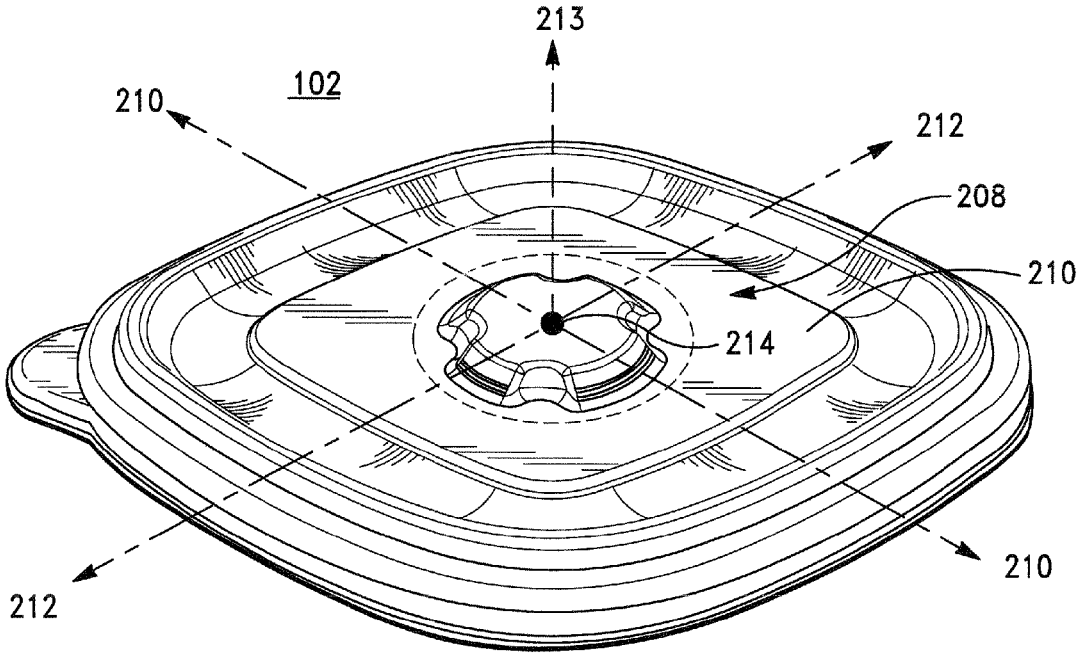
FIG. 2A is a top isometric view of the top of the cover of FIG. 1 showing the top of an engagement portion of the cover.
Figure 2B:
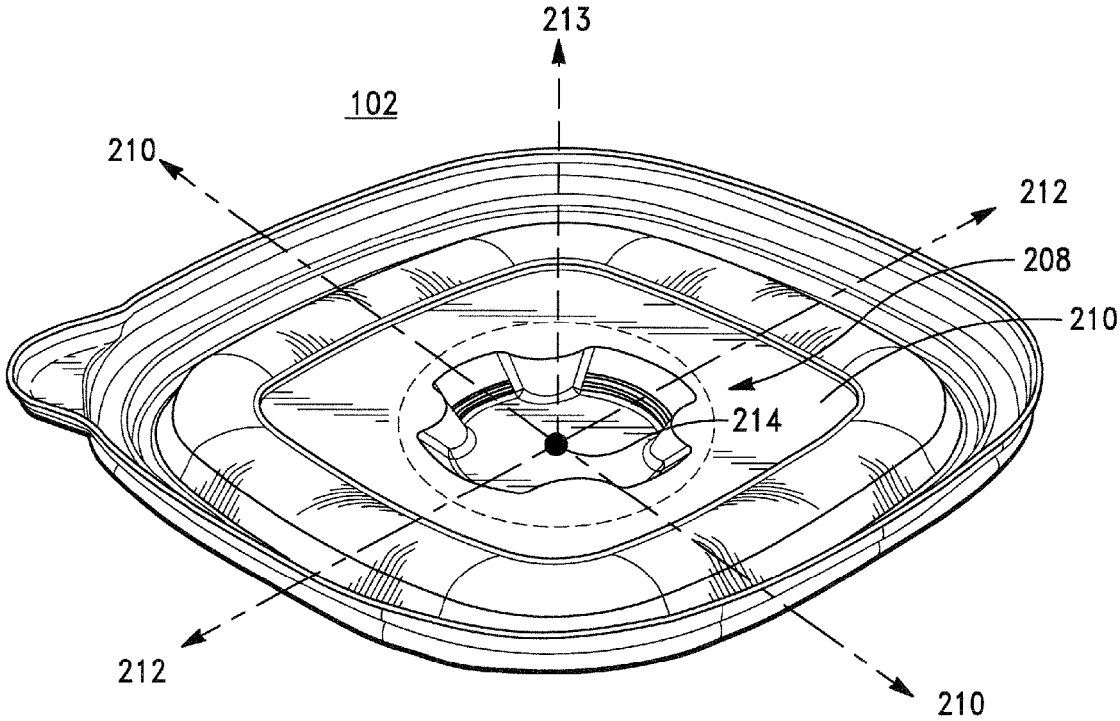
FIG. 2B is a bottom isometric view of the bottom of the cover of FIG. 1 showing the bottom of the engagement portion of the cover.

The cover 102 illustrated in FIGS. 2A and 2B includes an engagement portion 208 that allows the cover 102 to engage with an engagement portion of a second cover to form a locked stack of covers. This locking feature makes the resultant stack of covers more structurally rigid and thus less precarious than a traditional, non-interlocked, stack of covers. In one embodiment, the engagement portion 208 of the cover 102 illustrated in FIGS. 2A and 2B is centered within a center panel 210 at the top surface of the cover 102. Engagement portion of the cover 102 need not be centered within the center panel 210 of cover 102. Further, more than one engagement portion 208 may be located on the top surface of the cover 102 to accommodate interlocking engagement of multiple container covers at more than one position on the top surface of the cover 102.

The engagement portion 208 of is depicted as circular but, as with the shape of the container 100 (FIG. 1) itself, other shapes are possible. In some embodiments, a standard shape and configuration of the engagement portion 208 is used with covers 102 of various shapes and sizes. This enhances storage flexibility by allowing different types of covers 102 to be stored together in a locked stack. A standard shaped and configured engagement portion 208 may be used with, for example, circular, square, rectangular, and elliptical shaped containers.

The engagement portion 208 can also be chosen to have a shape or otherwise include elements that provide rotational alignment of a stack of covers 102. Rotation is defined about a central axis 213 normal to the plane formed by orthogonal midlines, i.e., first midline 211 and second midline 212, of the cover 102 as shown in FIG. 2A. The origin of the central axis 213 is at a center point 214 at which the orthogonal midlines 210 and 212 intersect. For instance, shapes that inherently require rotational alignment prior to engagement or that may be self-aligning during the process of connecting engagement portions would be shapes with linear or curvilinear sides, vertices or lobes such as triangular, square, rectangular, or multi-petal shapes. Additionally, the cover may have one or more elements on or about the engagement portion 208 that require alignment prior to connection of the engagement portions.

The cover 102 of can be constructed with a wall thickness thinner than that of a base 104 (FIG. 1). The cover 102 can be made from any suitable plastic and can be integrally made by any suitable technique, such as thermoforming. In one embodiment, the cover 102 can be formed from polypropylene. Due to the thermoforming process, the wall thickness of the cover 102 can vary. A thinner cover 102 reduces material costs and increases flexibility to more easily accommodate its removal from, and engagement with, a base 104 (FIG. 1). The cover 102 can maintain adequate flexibility for proper sealing even during typical freezer temperatures.

The cover 102 can be sufficiently flexible to allow a user to create a vacuum in the container 100 of FIG. 1 upon sealing. In order to create a vacuum, the user could, for example, depress the cover 102 during the closing of the container 100. A return force imparted upon the cover 102 by the resiliency of the material of the cover 102 will urge the cover 102 to return to its normal position, thereby creating a vacuum.

Figure 3:
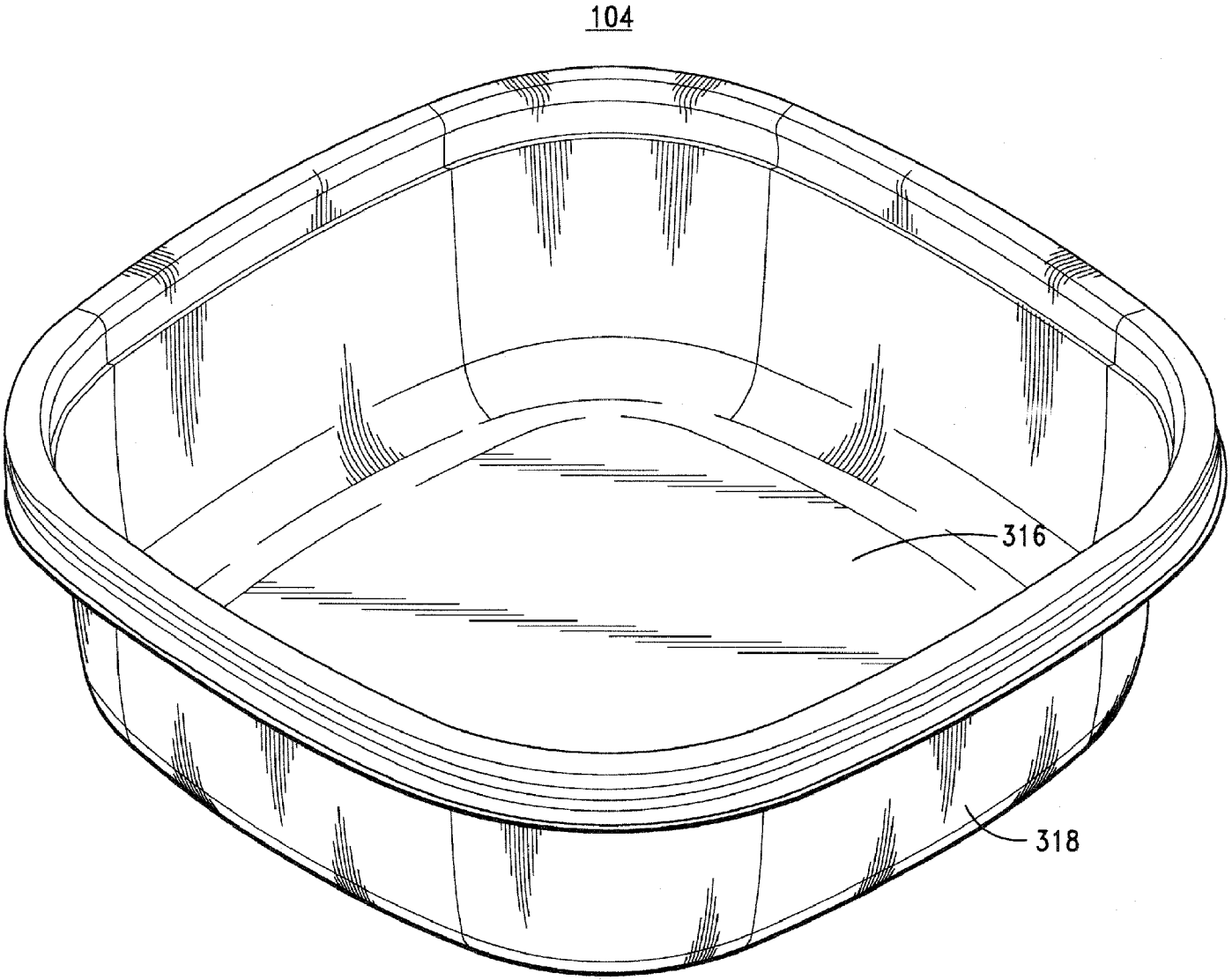
FIG. 3 is a top isometric view of the base of FIG. 1.
Figure 4A:
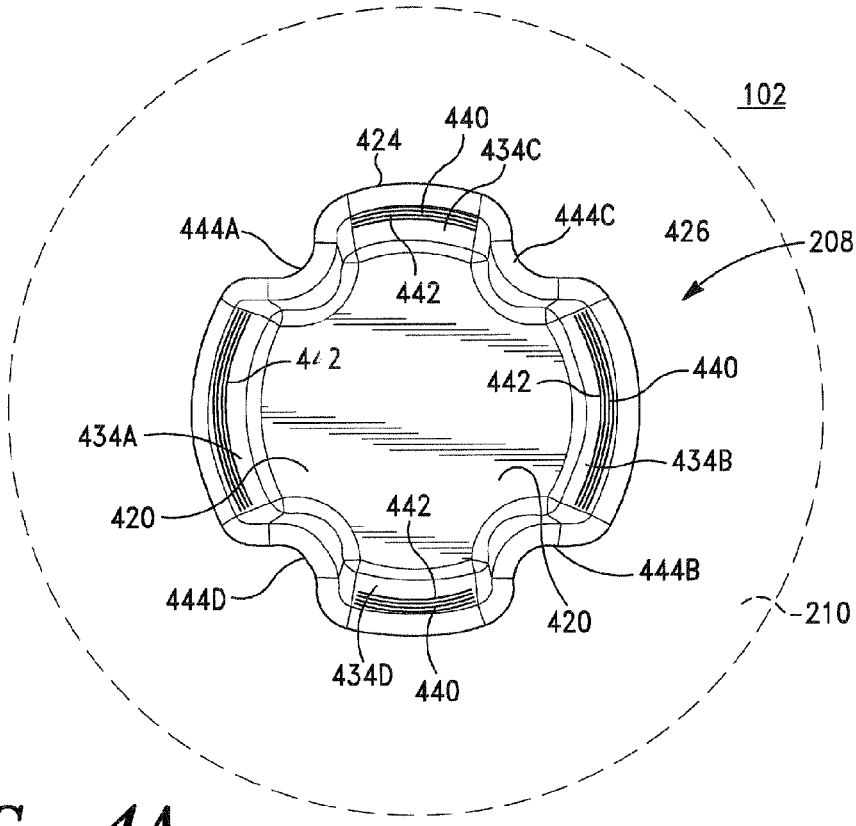
FIG. 4A is a top plan view of the portion of the cover of FIG. 2A marked in dotted line and showing the details of the top of the engagement portion of the cover.
Figure 4B:
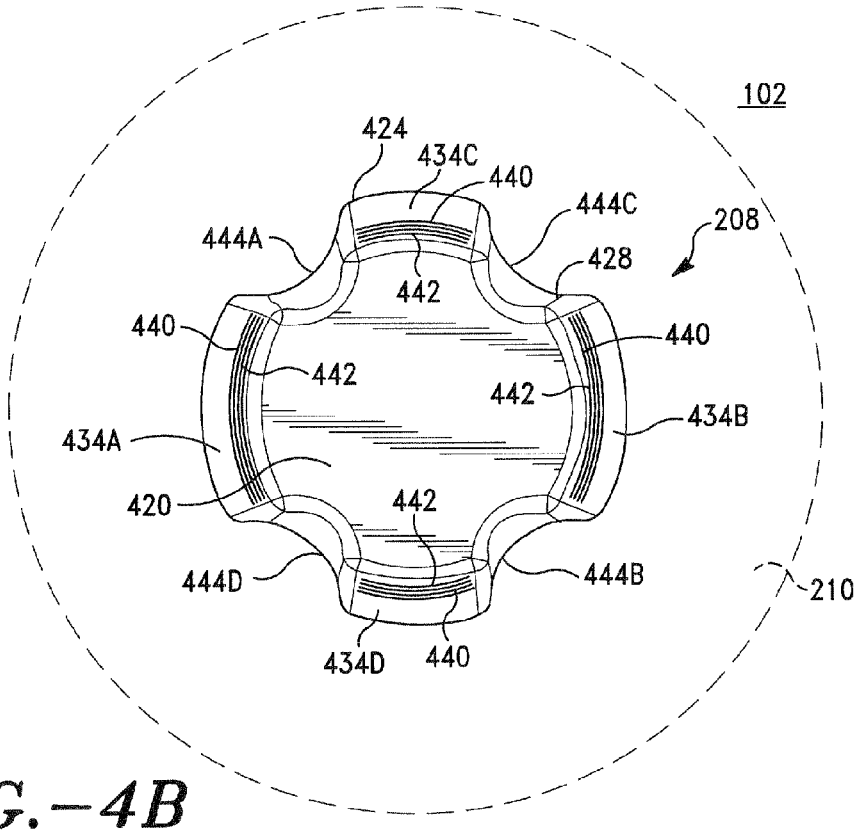
FIG. 4B is a bottom plan view of the portion of the cover of FIG. 2B marked in dotted line and showing the details of the bottom of the engagement portion of the cover.

The base 104 of FIG. 3 includes a bottom 316 and a base sidewall 318 extending from the periphery of the bottom 316. The base 104 can be integrally made from any suitable plastic with sufficient thickness to withstand without deforming the heat of microwave cooking and of top-shelf dishwashing. It should also remain sturdy during lifting while laden with hot food. The base 104 can be made from any suitable plastic and can be made by any suitable technique, such as co-extrusion, lamination, injection molding, thermoforming, or overmolding. As is well known in the art, the same forming process is typically used to form both the base 104 and the cover 102 of container 100. In one embodiment, the base 104 is formed from polypropylene. The wall thickness of the base 104 can vary due to the manufacturing process FIG. 4A is a top plan view of the portion of the cover 102 of FIG. 2A marked in dotted line and showing the details of the top of the engagement portion 208 of the cover 102. FIG. 4B is a bottom plan view of the portion of the cover 102 of FIG. 2B marked in dotted line and showing the details of the top of the engagement portion 208 of the cover 102. When viewed from the top of the cover 102 as in FIG. 4A (See also FIG. 2A), in one embodiment, the engagement portion 208 of cover 102 is configured generally as a hollow, frusto-conically shaped projection directed upwardly from the top of the center panel 210 of the cover 102. Accordingly, the engagement portion 208 has an engagement draft angle, well know to those of ordinary skill in the art, that allows nesting of engagement portions of similarly configured covers.

The engagement portion 208 includes a cap 420 configured generally as a disk above the top of the cover 102. The cap 420 has a perimeter edge at its periphery. The entire perimeter edge of the cap 420 is coupled to the top of the center panel 210 of the cover 102 by a engagement sidewall 424 that generally slopes outwardly from the cap 420 to the center panel 210 of the cover 102. The engagement sidewall 424 has a sidewall outside surface 426 and a sidewall inside surface 428 (FIG. 4B) with edges therebetween. The top edge of the engagement sidewall 424 couples with the perimeter edge of the cap 420. The bottom edge of the engagement sidewall 424 couples with the top of the cover 102 at its center panel 210. In one embodiment, the above-described elements of the engagement portion 208 are integrally formed in processes well known to those of ordinary skill in the art. Thermoforming of plastic material is one such process, given only by way of example and not limitation.

The cap 420 and the engagement sidewall 424 of the engagement portion 208 define one or more engagement lugs 434 spaced apart circumferentially about the perimeter edge of the cap 420 and extending downwardly and outwardly from the perimeter edge of the cap 420 to the top of the cover 102. In the embodiment shown in the Figures, the engagement portion 208 includes four engagement lugs 434A-434D, which are made up of two pairs of opposing engagement lugs. The first pair of engagement lugs includes engagement lug 434A and engagement lug 434B opposite engagement lug 434A. In one embodiment, engagement lugs 434A and 434B are identically configured. The second pair of engagement lugs includes engagement lugs 434C and 434D opposite engagement lug 434C. In one embodiment, engagement lugs 434C and 434D are identically configured. In the embodiment shown in the Figures, the first pair of engagement lugs 434A and 434B is larger and subtends a greater arc angle about central axis 213 (FIG. 2A) than does the second pair of engagement lugs 434C and 434D. In other embodiments, the number of engagement lugs may be greater or less than four and the pairs of engagement lugs need not be identically configured. The engagement lugs 434A-D have corresponding lug outside surfaces 436A-D (FIG. 5A) and a corresponding lug inside surfaces 438A-D (FIG. 5C).

Figure 5A:
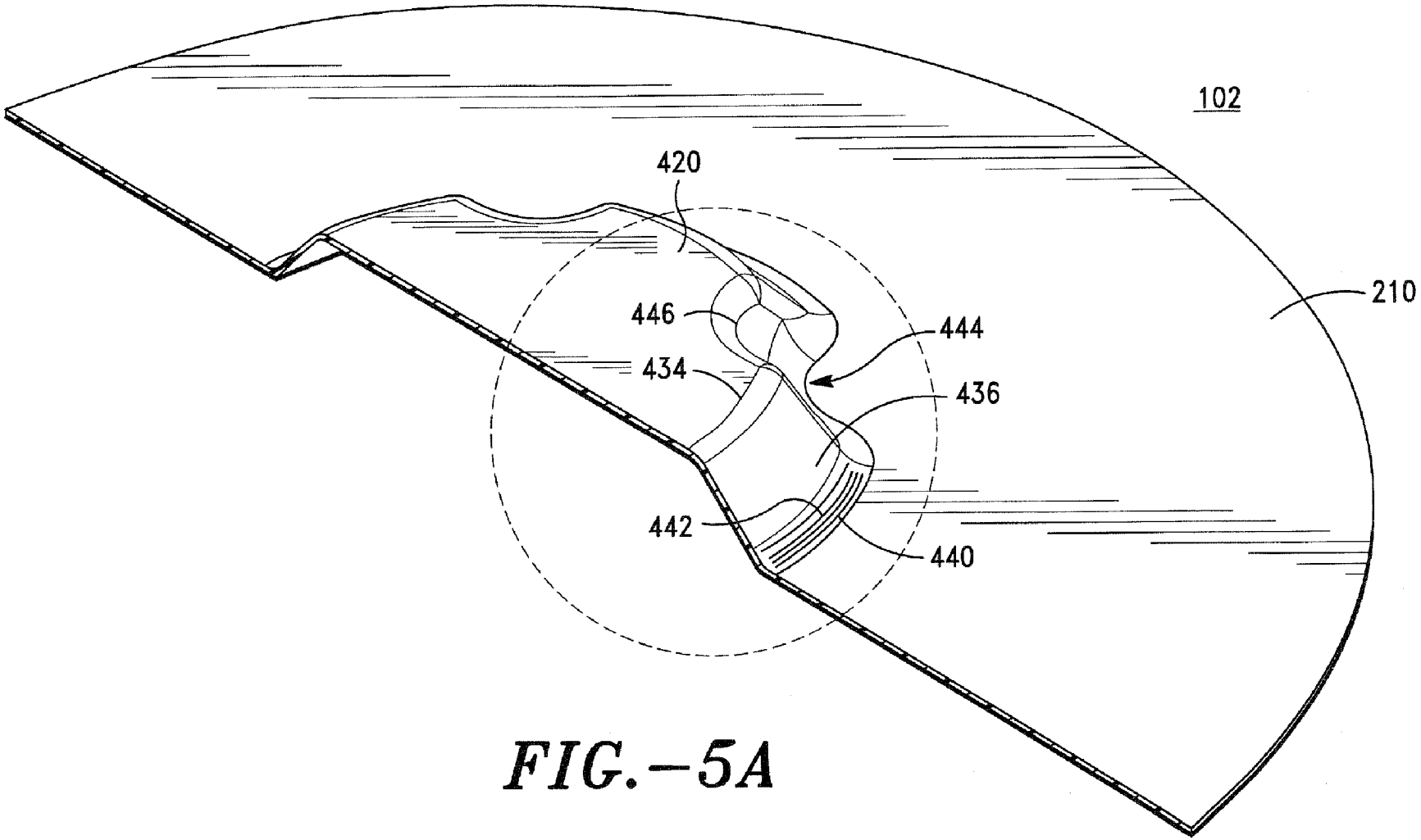
FIG. 5A is a top isometric view of a cross-section of the cover of FIG. 2A taken along a first midline of the cover.
Figure 5B:
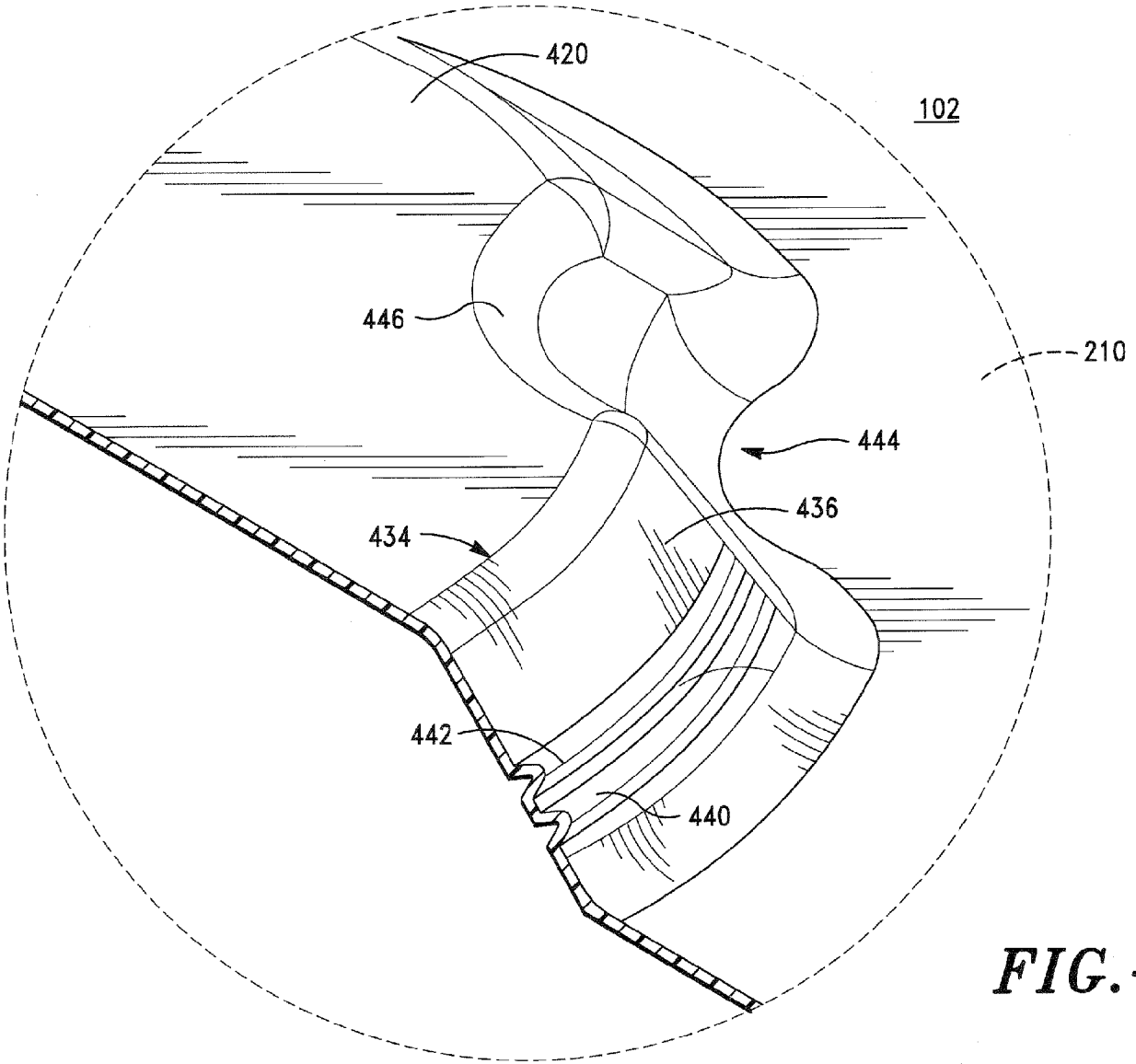
FIG. 5B is a close-up view of the part of the engagement portion of FIG. 5A marked in dotted line that shows further details of the engagement portion.
Figure 5C:
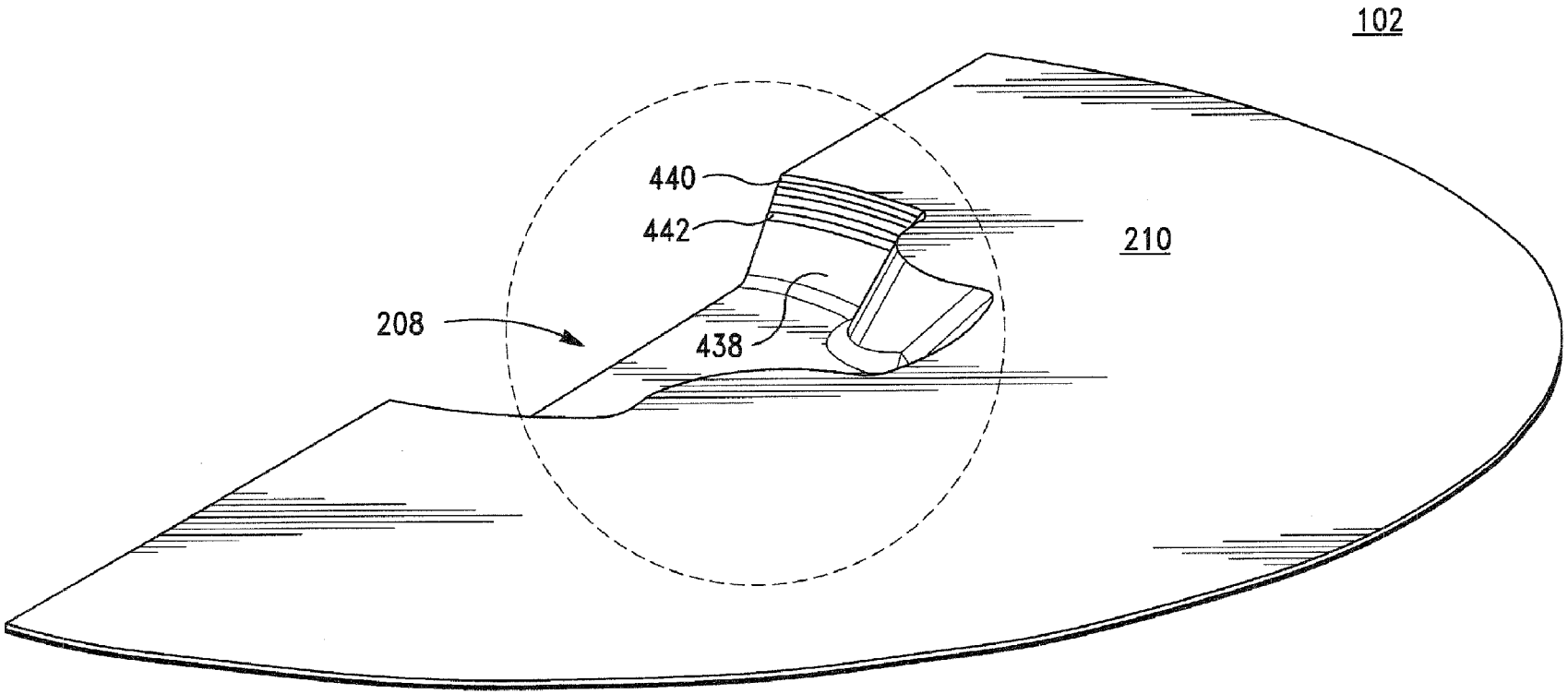
FIG. 5C is a bottom isometric view of a cross-section of the cover of FIG. 2B taken along a second midline of the cover.
Figure 5D:
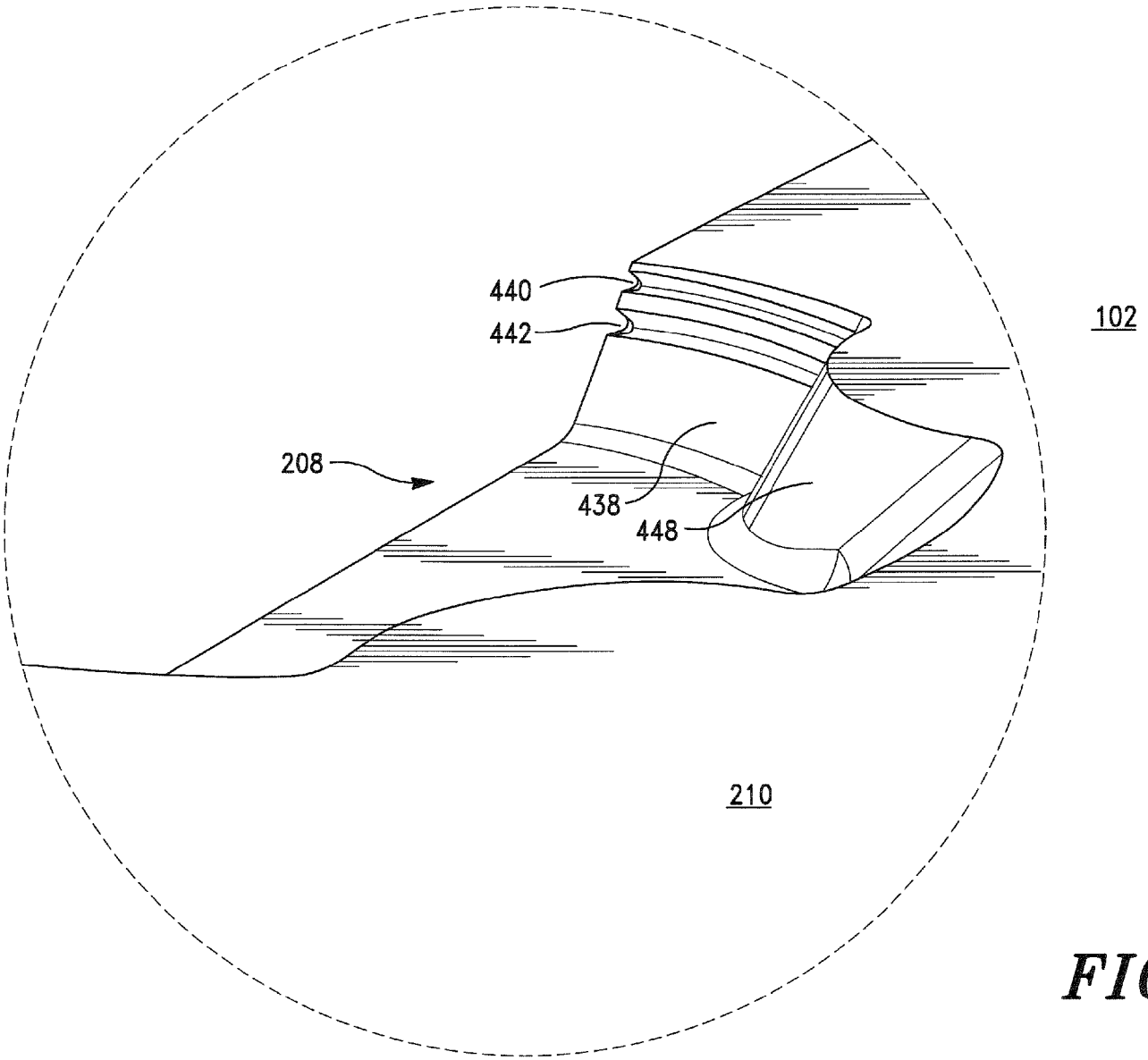
FIG. 5D is a close-up view of the part of the engagement portion of FIG. 5B marked in dotted line that shows further details of the engagement portion.

Referring now to FIGS. 4A, 4B, 5A, and 5B together, the lug outside surfaces 436 of the engagement lugs 434 each include a lower locking protrusion 440 near where the engagement sidewall 424 (FIG. 4A) joins the bottom surface of the center panel 210 of the cover 102. Above each lower locking protrusion 440 is an upper locking protrusion 442. When viewed from the top and as best seen in FIG. 5B, each lower 440 and upper 442 locking protrusion projects convexly outward from the lug outside surface 436 in a direction away from central axis 213 (FIG. 2A). More particularly, the lower 440 and upper 442 locking protrusions are seen as ridges directed and curved along the engagement lug outside surfaces 436 of and parallel to the top of the cover 102. When viewed from the bottom and as best seen in FIG. 5D, each lower 440 and upper 442 locking protrusion projects concavely from the lug inside surface 438. More particularly, the lower 440 and upper 442 locking protrusions are seen as indentations directed and curved along the engagement lug inside surfaces 438. As described more fully below, each of the lower locking protrusions 440 on at the lug outer surface 436 of the engagement lugs 424 of the engagement portion 208 of the cover 102 is adapted to receivingly engage and lock a corresponding one of an upper locking protrusion of an engagement portion of a second cover (see FIG. 6B).

Referring again to FIGS. 4A and 4B together, the engagement portion 208 of the cover 102 further includes one or more drainage channels 444 spaced apart circumferentially about the perimeter edge of the cap 420 between the engagement lugs 424. The drainage channels 444 have a channel outside surface 446 and a channel inside surface 448 (see also FIG. 5D). When viewed from the top of the cover 102 as in FIGS. 1 and 4A, the drainage channels 444 are configured generally as inwardly directed convex indentations, sometimes called punts, into and traversing the sidewall outside surface 426 of the engagement sidewall 424 (FIG. 4A) of the engagement portion 208. In the embodiment shown in the Figures, the engagement portion 208 includes four identically configured drainage channels 444A-444D between the engagement lugs 424 of the engagement portion 208. In other embodiments, the number of drainage channels 444 may be greater or less than four and the drainage channels 444 need not be identically configured.

The drainage channels 444 extend outwardly and downwardly from the perimeter edge of the cap 420 to the bottom edge of the engagement sidewall 424 where it joins the top of the cover 102 at the center panel 210. The drainage channels 444 together define a channel draft angle. In one embodiment, the channel draft angle defined by the drainage channels 444 is greater than the engagement draft angle defined by the engagement lugs 424. As described more fully below, when a second cover is lockingly engaged above the cover 102, a passageway is formed between the channel outside surface 446 of a drainage channel 444 of the cover 102 and the channel inside surface of the second cover above the cover 102.

Figure 6A:
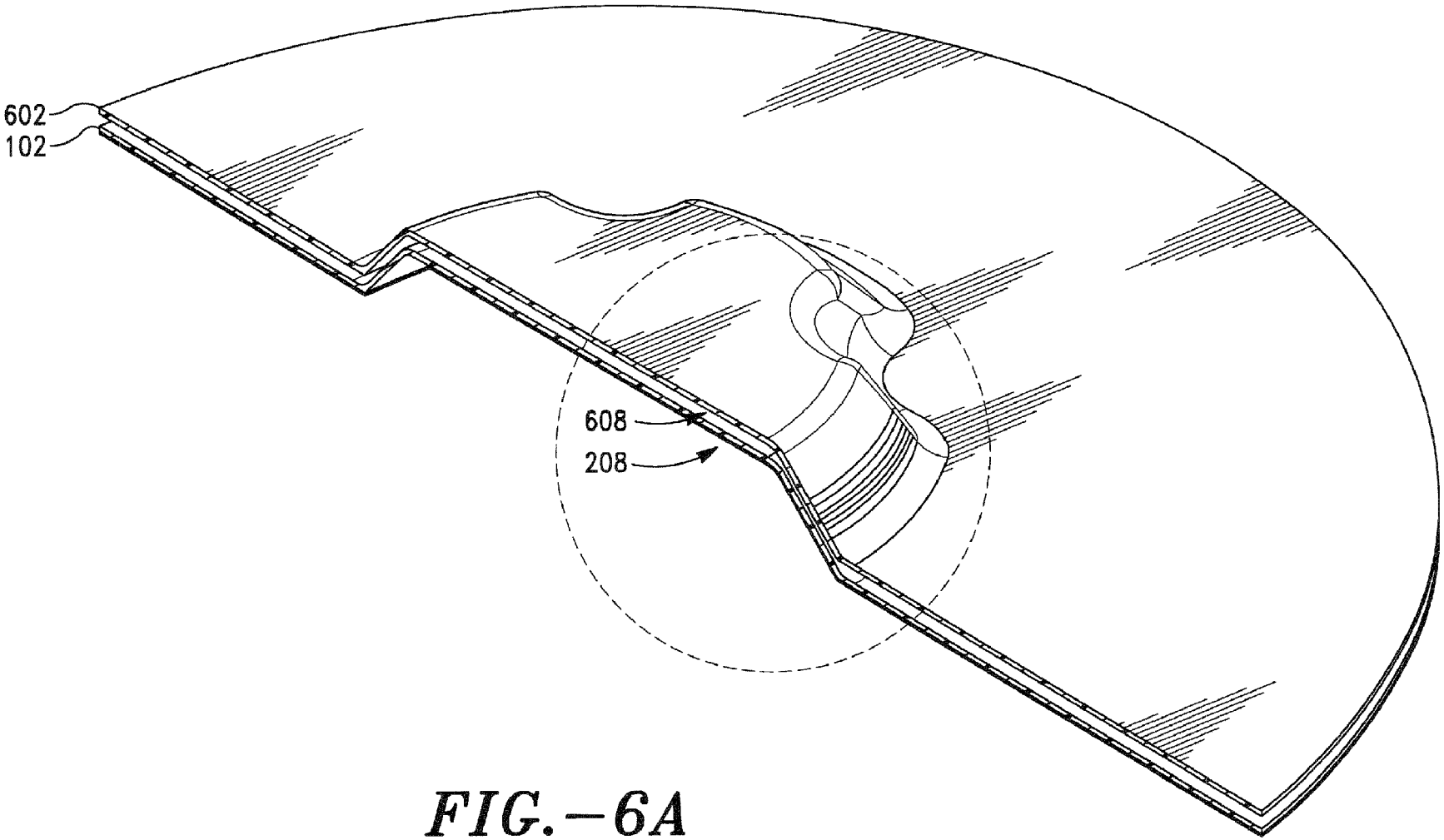
FIG. 6A is a top isometric view of a cross-section similar to FIG. 5A showing a cover locked with a second cover.
Figure 6B:
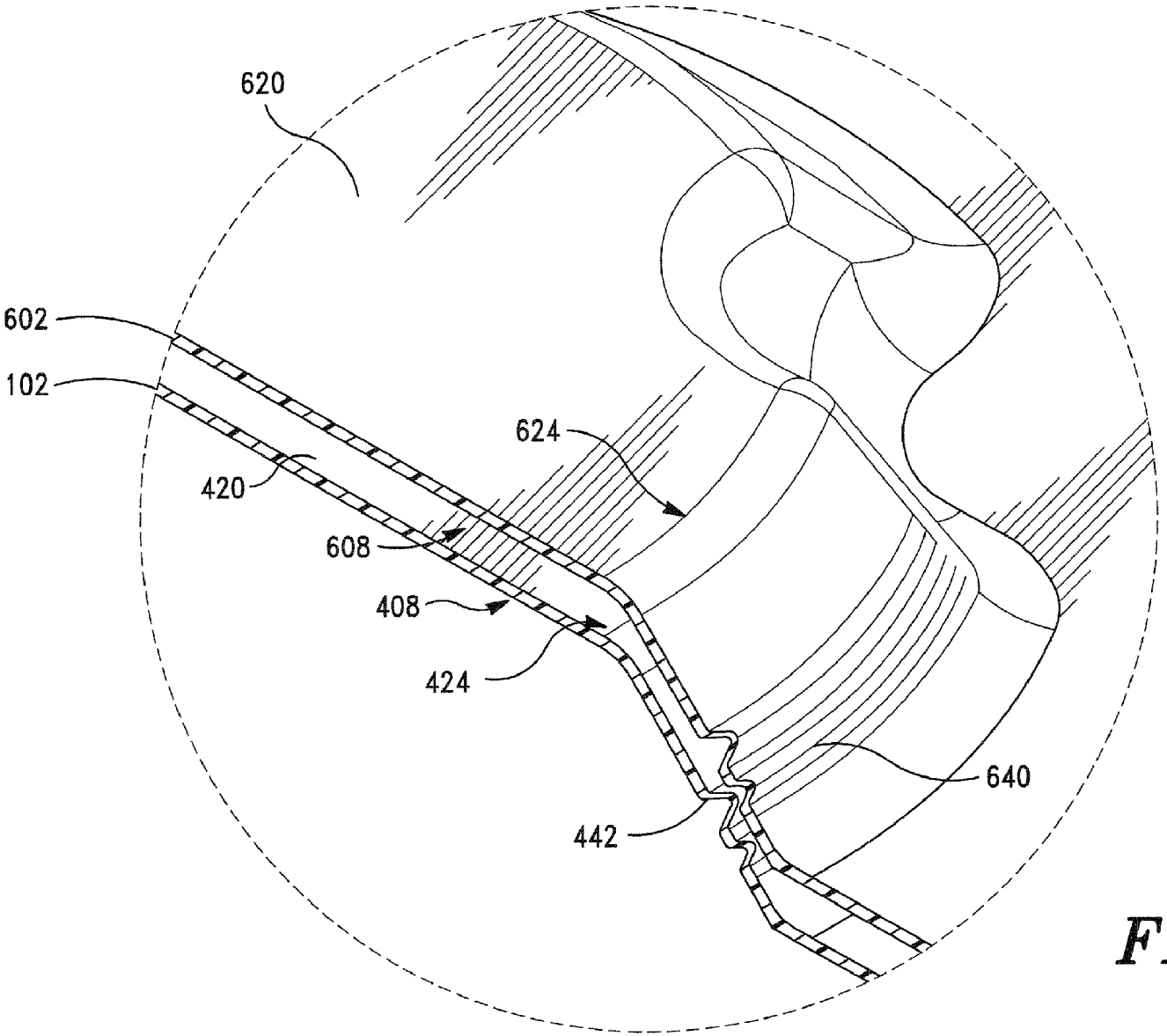
FIG. 6B is a close up view of the area of FIG. 6A shown in dotted line.
Figure 7:
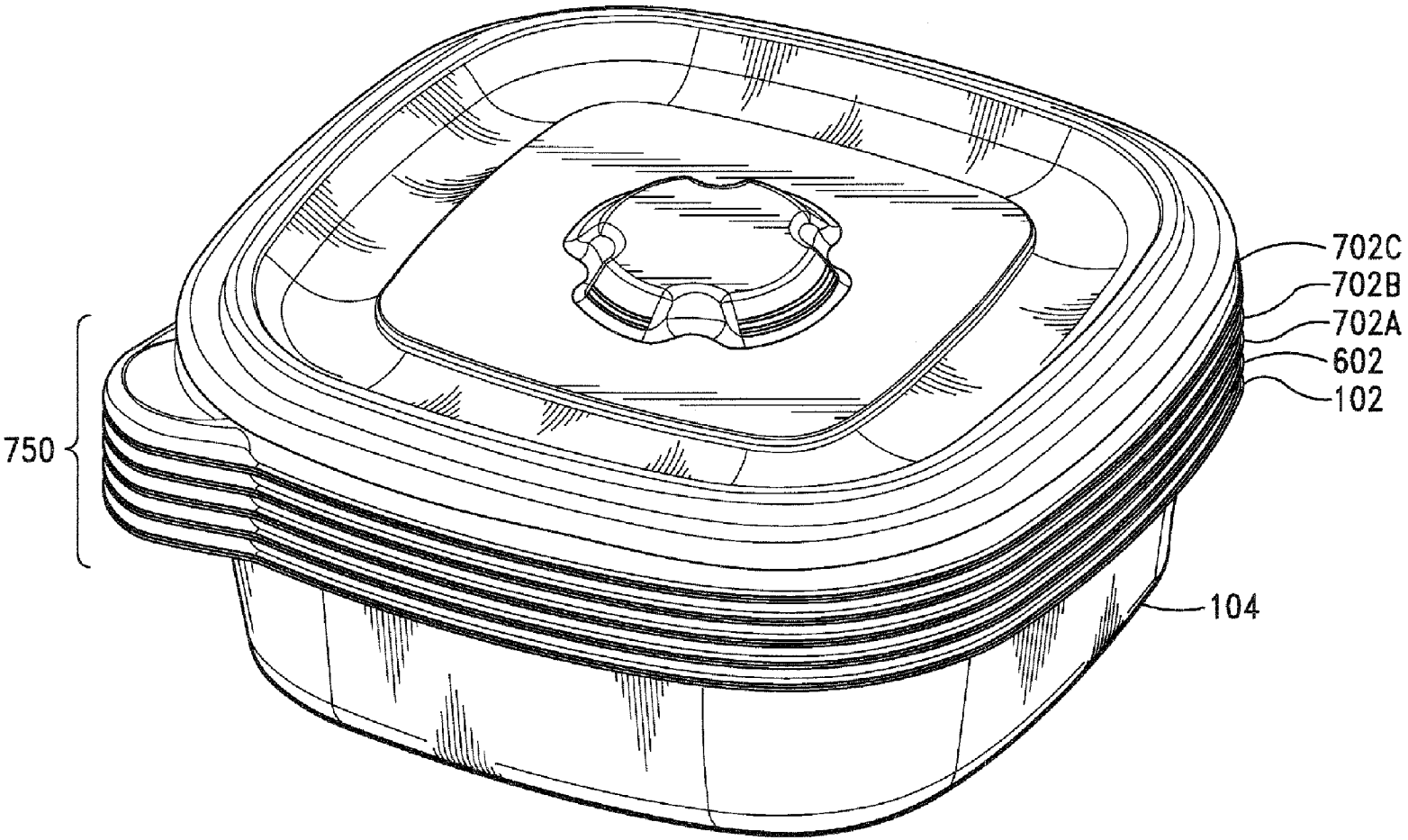
FIG. 7 is an isometric view of a sealed container showing a base and a container cover with a stack of locked covers lockingly engaged with the cover of the sealed container.

FIGS. 6A, 6B, and 7 show the utility of an embodiment of the invention when the container covers are releasably interlocked in storage. FIG. 6A is a top isometric view of a cross-section similar to FIG. 5B showing the cover 102 locked with a second cover 602. FIG. 6B is a close up view of the area of FIG. 6A shown in dotted line. As shown in Figures, the engagement portion 208 of the cover 102 is lockingly engaged with the engagement portion 608 of a second cover 602 to form a system of interlocked covers. The cover 102 and the second cover 602 are locked together by their respective engagement portions 208 and 608.

In a manner similar to the cover 102, each of four engagement lugs 634 of an engagement portion 608 of the second cover 602 includes a lower locking protrusion 640 and an upper locking protrusion 642 above the lower locking protrusions 640. Each lower 640 and upper 642 locking protrusion projects outwardly and each protrusion is convex at a lug outside surface 636 and concave at a lug inside surface 638 of each of the engagement lugs 634 of the second cover 602.

As best seen in FIG. 6B, when locked the lower locking protrusion 640 of each engagement lug 624 of the engagement portion 608 of the second cover 602 fits over the upper locking protrusion 442 of the engagement portion 208 of the cover 102 underneath it, thus locking the covers 102 and the second cover together. Said another way, the upper locking protrusion 442 of each engagement lug 208 of the engagement portion 208 of the cover 102 is receivingly engageable by the lower locking protrusion 640 of the engagement portion 608 of the second cover 602. In this manner, the covers 102 and 602 are held and locked together, sometimes called interlocked, and form a structurally stable cover stack. Typically, cooperating upper and lower protrusions from a liquid-tight seal.

To interlock covers 102 and 602 for the embodiment of the present invention shown in the Figures, a user rotationally aligns the second cover 602 about the central axis 213 (FIG. 2A) of the cover 102 such that the engagement lugs 634 of the second cover 602 rotationally align with a corresponding engagement lugs 434 of the cover 102. As used herein an engagement lug of a cover is said to be corresponding with the engagement lug of a second if the engagement lugs may form a locking relationship between the covers. Next, the user applies a downward force substantially normal to the top of the second cover 602 thereby effecting locking engagement of engagement portion 608 of the second cover 602 with the engagement portion 208 of the cover 102. Furthermore, during the process when the user aligns the cover 102 with the second cover 602 and applies a force to the second cover 602 in a direction normal to the plane of the second cover top so as to lock the covers together, the engagement portions can provide tactile or audible feedback upon locking. In the embodiment shown, for example, the lower locking protrusion 640 of the of the second cover 602 provides an audible snapping sound as is fitted over the upper locking protrusion 442 of the cover 102. In this way, the user would sense that the covers are connected and that no further force need be applied.

If the cap 420 (FIG. 6B) of the cover 102 is wetted with liquid when locked with the second cover 602, the drainage channels 444 (FIG. 5B) spaced apart circumferentially about the perimeter edge of the cap 420 between the engagement lugs 424 provide a means for draining or evaporating the liquid from the cap 420 of the first cover 102. As described above, the drainage channels 444 have a channel outside surface 446 (FIG. 5B) and a channel inside surface 448 (FIG. 5D). Similarly, the second cover includes drainage channels spaced apart circumferentially about the perimeter edge of the cap between the engagement lugs of the second cover. The drainage channels of the second cover have a channel outside surface and a channel inside surface. When cover 102 and second cover 602 are lockingly engaged, the drainage channel of the covers are configured such that the inside surfaces of the drainage channels of the second cover stand-off from the outside surfaces 446 of the drainage channels 444 of the cover 102 to provide a gap or passage way for draining and evaporating liquid. Without drainage channels 444, liquid cannot drain and only slowly evaporates between interlocked engagement portions of the covers since the cooperating upper and lower protrusions may form a liquid tight seal. Thus, by the principles of the present invention covers may be interlocked while at the same time liquid trapped between the interlocked covers may drain or quickly evaporate.

Referring to FIG. 6B, once lockingly engaged, the engagement portion 608 of the cover 602 is disengageable from the engagement portion 208 of the cover 102 immediately below the second cover 602. A user may grab the gripping tab (not shown) or other portion of the second cover 602 while at the same time holding the cover 102 below the second cover 602. In an upwardly and inwardly directed lifting motion on the tab of the second cover 602, the second cover 602 is flexed to release the second cover 602 from the cover 102. More particularly, by this action supplied by a user, the lower locking protrusion 640 of the of the second cover 602 is peeled back and pulled away from and finally released from locking engagement with the upper locking protrusion 442 of the cover 102. By this means, engagement portion 608 of second cover 602 may be released from locking engagement with the engagement portion 208 of the cover 102. Accordingly, through use of embodiments of the present invention, the top cover of interlocked covers may be easily released from a locking engagement and removed.

Referring to FIG. 7, similarly, a third cover 702A, includes an engagement portion 708A. The engagement portion 708A of the third cover 702A is configured as described above for the cover 102 and the second cover 602. The engagement portion 708A of the third cover 702A may be locked with the engagement portion 608 of the second cover 602 in a manner similar to that described above for locking the cover 102 with the second cover 602. Likewise, an engagement portion 708B of a fourth cover 702B may be locked with the engagement portion 708A of the third cover 702A and an engagement portion 708C of a fifth cover 702C may be locked with the engagement portion 708B of the fourth cover 702B to form a locked stack 750 of five covers as shown in FIG. 7. The locked stack may be placed on the base 104 of the container 100 of FIG. 1 by sealingly engaging the first closure portion of the cover 102 with the second closure portion of the base 104, as described above and as shown in FIG. 7.

Other embodiments of the engagement portion may include one or more of the following features to enable engagement: convex portions or ribs, concave portions or ribs, linear or curvilinear undercuts, discrete snap elements or buttons, interference fits, textured surfaces, or elements that modify surface friction or tackiness at or around the point of engagement. The engaging areas that create a locking condition can be continuous about the engagement portion or discretely segmented about the engagement portion. In some embodiments, the force required to connect the covers may differ substantially from the force required to disengage the covers. For instance, it may be beneficial during manufacturing that the force needed to connect the covers is less than the force required to separate the covers. As a result, the covers are relatively easy to connect during manufacturing, yet they will lock securely and not undesirably separate during the manufacturing process. To accomplish this, the protrusions on the engagement portion may be designed where, for a given protrusion, the upper protrusion edge comprises a gradual taper whereas the lower protrusion edge comprises a more abrupt shape. For example, in one embodiment, the shape of the protrusion may be similar to a barbed hook with gradual taper on the upper edge of the barb that would impart little resistance during engagement and with an abrupt shape on the lower edge of the barb that would impart relatively high resistance during disengagement. Conversely, it may be beneficial to design the engagement portion so that the force that needs to be applied to connect the covers is more than the force required to separate the covers, since the user may perceive that a high connecting force equates to satisfactory locking integrity, whereas a weak connecting force may lead the user to perceive that the cover stack lacks the integrity required to insure the expected organizational benefit. Thus, the high connecting force provides the perceived benefit, yet a lower disengagement force does not require that the user untowardly struggle during separation of covers. To accomplish this, the protrusions on the engagement portion may be designed where, for a given protrusion, the upper protrusion edge comprises an abrupt shape whereas the lower protrusion edge comprises a more gradual taper. For example, in one embodiment, the shape of the protrusion may be a reversed barb with an abrupt shape on the upper edge of the barb that would impart relatively high resistance during engagement and with a gradual taper on the lower edge of the barb that would impart little resistance during disengagement. Furthermore, during the process where the user applies force to aligned covers in a direction normal to the general cover plane so as to lock the covers together, the engagement portion can provide tactile or audible feedback upon locking. In this way, the user would sense that the covers are connected and that no further force need be applied.

Other embodiments of the engagement portion may include one or more of the following features to enable locking engagement: convex portions or ribs, concave portions or ribs, linear or curvilinear undercuts, discrete snap elements or buttons, interference fits, textured surfaces, or elements that modify surface friction or tackiness at or around the points of engagement. The engaging areas that create a locking condition can subtend various contact angles α about the center point 214 and along the engagement wall 602. In one embodiment, contact angle α is about 30°. In some embodiments, the force required to connect the covers may differ substantially from the force required to disengage the covers. For instance, it may be beneficial during manufacturing that the force needed to connect the covers is less than the force required to separate the covers. As a result, the covers are relatively easy to connect during manufacturing, yet they will lock securely and not undesirably separate during the manufacturing process. To accomplish this, the protrusions on the engagement portion may be designed where, for a given protrusion, the upper protrusion edge comprises a gradual taper whereas the lower protrusion edge comprises a more abrupt shape. For example, in one embodiment, the shape of the protrusion may be similar to a barbed hook with gradual taper on the upper edge of the barb that would impart little resistance during engagement and with an abrupt shape on the lower edge of the barb that would impart relatively high resistance during disengagement. Conversely, it may be beneficial to design the engagement portion so that the force that needs to be applied to connect the covers is more than the force required to separate the covers, since the user may perceive that a high connecting force equates to satisfactory locking integrity, whereas a weak connecting force may lead the user to perceive that the cover stack lacks the integrity required to insure the expected organizational benefit. Thus, the high connecting force provides the perceived benefit, yet a lower disengagement force does not require that the user untowardly struggle during separation of covers. To accomplish this, the protrusions on the engagement portion may be designed where, for a given protrusion, the upper protrusion edge comprises an abrupt shape whereas the lower protrusion edge comprises a more gradual taper. For example, in one embodiment, the shape of the protrusion may be a reversed barb with an abrupt shape on the upper edge of the barb that would impart relatively high resistance during engagement and with a gradual taper on the lower edge of the barb that would impart little resistance during disengagement. Furthermore, during the process where the user applies force to aligned covers in a direction normal to the general cover plane so as to lock the covers together, the engagement portion can provide tactile or audible feedback upon locking. In this way, the user would sense that the covers are connected and that no further force need be applied.

In accordance with embodiments of the present invention, the container can be reusable, but it can also be constructed cheaply enough that consumers see it as a disposable item, with replacement covers and bases available separately for retail sale. The base and the cover can be fabricated by thermoforming a plastic such as clarified polypropylene homopolymer material. In another embodiment, both the cover and base of the container may be fabricated by thermoforming a clarified random copolymer polypropylene material. Other plastic materials which would be suitable for fabricating the container by thermoforming include PS (polystyrene), CPET (crystalline polyethylene terephthalate), APET (amorphous polyethylene terephthalate), HDPE (high density polyethylene), PVC (polyvinyl chloride), PC (polycarbonate), and foamed polypropylene. The material used can be generally transparent to allow a user to view the contents of the container.

The container may include a visual indication of closure between the cover and the base. The visual indication may be a color change in the area where the cover engages the base. In one embodiment, the closure portion on the cover may be a first color and the closure portion on the base may be a second color. When the closure portions are engaged, the first and second colors produce a third color which is visible to the user to indicate that the container is sealed.

The container may include a rough exterior surface to reduce slipping and to improve grasping by the user, especially if the user's hands are wet or greasy. In addition, the pinching bar may all have a rough exterior to aid in application of the pinching force supplied by a user to disengage interlocked covers.

The container may include a self-venting feature. The pressure in the sealed container may increase when the sealed container and contents are heated in a microwave oven. Thus, the cover may include a self-venting mechanism which opens when the pressure in the container exceeds a predetermined value.

The container may be divided to separate foods in the container. A divider may be integral with the container or may be a separate component. Either the base only may include a divider or both the base and the cover may each include a divider. The divider located in the cover may only partially engage the divider in the base so as to provide splash protection, or it may fully engage the divider in the base to provide varying degrees of inter-compartmental leak resistance.

The container may include a strip indicating the temperature of the container and its contents.

The gripping tab can include a relieved portion that provides less interference contact with the base during the removal or engagement of the cover while still providing an adequate closure portion to maintain proper sealing of the container. The relieved portions of the gripping tab permit venting by allowing a portion of the cover to be unsealed from the base while still maintaining a seal around the remaining perimeter of the container. This feature is useful in microwave cooking where the cover prevents food from splattering onto the inside surface of the microwave while still allowing the container to vent. By using the gripping tab, less force is required to remove the cover from the base. This lower opening force also reduces the possibility of container failure from stress and fatigue. The lower opening force can improve the ability of the user to maintain control over the container components while removing the cover from the base and thus to reduce the possibility of spilling the contents stored in the container.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

The directional terms "lower" and "upper", "inside" and "outside", and the like are used herein for ease of description in conjunction with the drawings. These terms are not meant to indicate that the structural components of the present invention must have a specific orientation except when specifically set forth above.

While the invention is described herein in connection with certain preferred embodiments, there is no intent to limit the present invention to those embodiments. On the contrary, it is recognized that various changes and modifications to the described embodiments will be apparent to those skilled in the art upon reading the foregoing description, and that such changes and modifications may be made without departing from the spirit and scope of the present invention. Skilled artisans may employ such variations as appropriate, and the invention may be practiced otherwise than as specifically described herein. Accordingly, the intent is to cover all alternatives, modifications, and equivalents included within the spirit and scope of the invention. Moreover, any combination of the above-described elements in all possible variations thereof is encompassed by the invention unless otherwise indicated herein or otherwise clearly contradicted by context.

The invention claimed is:

1. A plastic container comprising a cover and a base, said cover including a center panel having a top surface and a peripheral first closure portion surrounding said center panel;

said base including a second closure portion;

wherein said first closure portion of said cover is sealingly engageable with said second closure portion of said base so that when said first closure portion and said second closure portion are sealingly engaged with each other, said cover and said base define a substantially sealed storage area;

said cover having an engagement portion including a cap extending above said center panel, said cap comprising a perimeter edge and an engagement sidewall having two or more engagement lugs and two or more drainage channels spaced apart circumferentially about the perimeter of the edge of the cap between the engagement lugs, the engagement sidewall coupling the cap to the top surface of the center panel; wherein each of said engagement lugs of said engagement portion of said cover comprise a lower locking protrusion on a lug outside surface and an upper locking protrusion above said lower locking protrusion on said lug outside surface; and wherein one of said engagement lugs of said cover is releasably lockable with an engagement lug of a second cover and wherein all the engagement lugs are not identically configured.

2. A plastic container comprising a cover and a base, said cover including a center panel having a top surface and a peripheral first closure portion surrounding said center panel;

said base including a second closure portion;

wherein said first closure portion of said cover is sealingly engageable with said second closure portion of said base so that when said first closure portion and said second closure portion are sealingly engaged with each other, said cover and said base define a substantially sealed storage area;

said cover having an engagement portion including a cap extending above said center panel, said cap comprising a perimeter edge and an engagement sidewall having two or more engagement lugs and two or more drainage channels spaced apart circumferentially about the perimeter of the edge of the cap between the engagement lugs, the engagement sidewall coupling the cap to the top surface of the center panel; wherein each of said engagement lugs of said engagement portion of said cover comprise a locking protrusion on a lug outside surface; and wherein one of said engagement lugs of said cover is releasably lockable with an engagement lug of a second cover and wherein all the engagement lugs are not identically configured.

* * * * *